US006028520A

United States Patent [19]

Maehre

[11] Patent Number: 6,028,520

[45] Date of Patent: Feb. 22, 2000

[54] ANNUNCIATOR FOR A TOILET

[76] Inventor: Bob Maehre, 131 Winifred Ave., Worcester, Mass. 01602

[21] Appl. No.: 09/299,758

[22] Filed: Apr. 27, 1999

[51] Int. Cl.[7] ..... G08B 23/00

[52] U.S. Cl. ..... 340/573.1; 340/522; 340/689; 340/692

[58] Field of Search ..... 340/573.1, 522, 340/689, 692, 691.5; 4/661

[56] References Cited

U.S. PATENT DOCUMENTS

| | | | |
|---|---|---|---|
| 4,733,419 | 3/1988 | Nee . | |
| 4,849,742 | 7/1989 | Warrington . | |
| 4,896,144 | 1/1990 | Bogstad | 340/691 |
| 5,703,567 | 12/1997 | Cleveland . | |
| 5,748,096 | 5/1998 | Kaufer . | |
| 5,870,015 | 2/1999 | Hinkel | 340/573.1 |

*Primary Examiner*—Thomas Mullen

*Attorney, Agent, or Firm*—Terrance L. Siemens

[57] ABSTRACT

An annunciator for training individuals in toilet etiquette and sanitation. The annunciator has a small housing that hangs on the side of the toilet tank, is incorporated into the seat of the toilet or hangs from the flush handle of the toilet. The housing is preferably plastic and can be animal shaped, for example, like a frog. A sound module, batteries, internal sensors, controller and speaker are mounted in the housing and the controller is connected to the external sensors by electrical wires. A small light such as an LED can be included to indicate that the unit is working. The sensors detect a person near the toilet, the position of the toilet seat (lowered or raised), a person sitting on the seat, and operation of the flush handle. The controller decides what messages to play based on the sensed conditions. Additionally, the housing may contain a small separate tape player for music or prerecorded humorous sounds. The tape player is controlled by the annunciator to coordinate with any played messages. An on/off switch and volume control are also provided.

16 Claims, 2 Drawing Sheets

ANNUNCIATOR FOR A TOILET

BACKGROUND OF THE INVENTION

1. Field of the Invention

The present invention relates generally to sound producing devices. More particularly, the invention comprises an annunciator for a toilet that plays various prerecorded messages based on several sensed toilet conditions.

2. Description of the Prior Art

Devices for indicating the position of a toilet seat, and other toilet conditions are known in the prior art. The prior art includes both visual and audible devices for noting a toilet seat position. What is lacking in the prior art is a device that senses several toilet conditions (including toilet flushing, toilet seat occupied, toilet seat position and proximity of an individual to the toilet) and can play one or several of a number of prerecorded messages based on these conditions.

U.S. Pat. No. 4,733,419, issued to Nee on Mar. 29, 1988, discloses a toilet seat-up indicator. The indicator includes a flashing light, an integrated circuit flasher, a mercury switch, batteries and capacitors all in a flat curvilinear housing. The mercury switch activates the flasher when the seat is up, but no other bathroom or toilet conditions are sensed. The indicator can only display a single message, based on only a single condition (the seat position).

A toilet seat cover position alarm is detailed in U.S. Pat. No. 4,849,742, issued to Barrington on Jul. 18, 1989. The alarm senses both seat position and toilet tank water level, using sensors attached to a main unit by electrical wires. This basic construction is similar to the present invention and this patent is hereby incorporated by reference. The alarm is only sounded while both the seat is up, and the water level in the tank is low (indicating a flushing toilet). Seat occupancy and proximity are not sensed, and only one type of message (alarm) can be sounded.

U.S. Pat. No. 5,703,567, issued to Cleveland on Dec. 30, 1997, is drawn to a toilet seat alarm. This alarm is in a housing that duplicates a seat bumper in appearance. The alarm only sounds a single message (a series of beeps), based on only a single sensed condition (the seat position).

An illuminating and annunciating device for a toilet is disclosed in U.S. Pat. No. 5,748,096, issued to Kaufer on May 5, 1998. This device includes a small housing, an on/off switch, an LED and audio recording capabilities. While the device can illuminate a toilet bowl and play back a prerecorded message, there is only a single sensed condition (seat position) and only a single prerecorded message. Thus, this device cannot play one of a number of messages based on multiple toilet conditions.

None of the above inventions and patents, taken either singly or in combination, is seen to describe the instant invention as claimed.

SUMMARY OF THE INVENTION

The present invention is an annunciator for a toilet that plays one or more specific prerecorded message(s) from a number of stored messages. The specific message or messages played are determined by several sensed toilet conditions including: operation of the flush handle; occupation of the toilet seat; position of the toilet seat (up or down); and proximity of a person to the toilet. These sensed conditions can be logically combined to play messages that are particularly suited to the events taking place with respect to the toilet. The messages can be instructional to train or remind children and adults to lower the seat, flush the toilet and wash their hands. Gag messages may also be used, and can be combined with the instructional messages as well.

A first example involves simply sensing that an individual has walked within a certain predetermined distance of the toilet. This proximily can be sensed using many known techniques such as Doppler units used with outside flood lights. When an individual first approaches the toilet a message such as "Welcome, relax, sit down, take a load off." can be played as a practical joke or gag. On a more practical vein, should the seat position sensor (a simple mercury switch or other tilt sensor on the toilet seat itself), indicate that the seat is raised as an individual first approaches the toilet, a message such as "Be careful, the seat is raised" could be played to avoid a common bathroom mishap.

A second situation involves sensing a person sitting on the toilet seat. This can be done with a simple pressure switch mounted between the seat and rim of the toilet bowl. When a person first sits on the seat, a light on the unit comes on and a gag message could be played such as "Welcome to toilet central." or "Hope everything works out alright." Alternatively, the message could be of an educational nature such as "When you are finished, please flush the toilet and wash your hands." In other embodiments of the invention, this situation results in no audio message being played. After a person gets off the seat, the message played is "Please flush the toilet and wash your hands.", and after flushing the toilet (sensed by another tilt switch on the flush handle) a simple "Thank you" is played.

A third situation arises when an individual walks up to the toilet and raises the seat from the lowered position to the raised position (such as a man preparing to urinate standing up). This would prompt a message such as "please remember to lower the seat and flush when finished." Should the toilet be flushed prior to lowering the seat, the message "Please lower the seat and wash your hands." would be played. When the toilet seat is lowered, a simple "Thank you" is played. Should the seat still not be lowered, and the proximity switch indicates the person is still near the toilet, the message "Please lower the seat" may be repeated until the seat is lowered or the person leaves the area around the toilet.

The annunciator itself is in a small housing that hangs on the side of the toilet tank, is incorporated into the seat of the toilet or may hang from the flush handle of the toilet. The housing is preferably plastic and can be animal shaped for example like a frog. The housing contains the sound module, the batteries, the proximity sensor, and the speaker and is connected to the flush handle switch, the seat pressure switch and the seat position sensor by electrical wires. If the housing hangs from the flush handle, the seat position sensor (in the form of a switch closed by the seat) and the flush handle sensor can also be incorporated into the housing. A small light such as an LED can be included to indicate that the unit is working. The light could come on when a person is close to the toilet, and blink when the seat is raised, when the seat is not lowered after flushing, when a person gets on or off the toilet seat, or for various other situations.

Additionally, the housing may contain a small separate tape player for music or prerecorded funny sounds. An on/off switch and volume control is provided as well as having these functions controlled by the annunciator to coordinate with any played messages. Tapes having novelty sounds, prerecorded music or specially designed "bathroom music" could be used to enhance the overall audio functions of the device. Switches can also be provided to control the messages such that adult, child, and company modes can be selected. The switches and devices for sensing the toilet conditions are known in the art and it is the way these signals are combined to select specific audio messages, that is the main thrust of the present invention.

Accordingly, it is a principal object of the invention to provide an annunciator to assist in training children and adults in proper toilet etiquette and sanitation.

It is another object of the invention to provide an annunciator that plays humorous audio messages in a bathroom setting.

It is a further object of the invention to sense various toilet conditions and to use these sensed conditions to determine the most appropriate audio message out of a plurality of messages, for an annunciator on the toilet to play.

It is yet another object of the invention to train children to flush the toilet and wash their hands after using the toilet, and to train men to lower the toilet seat after use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
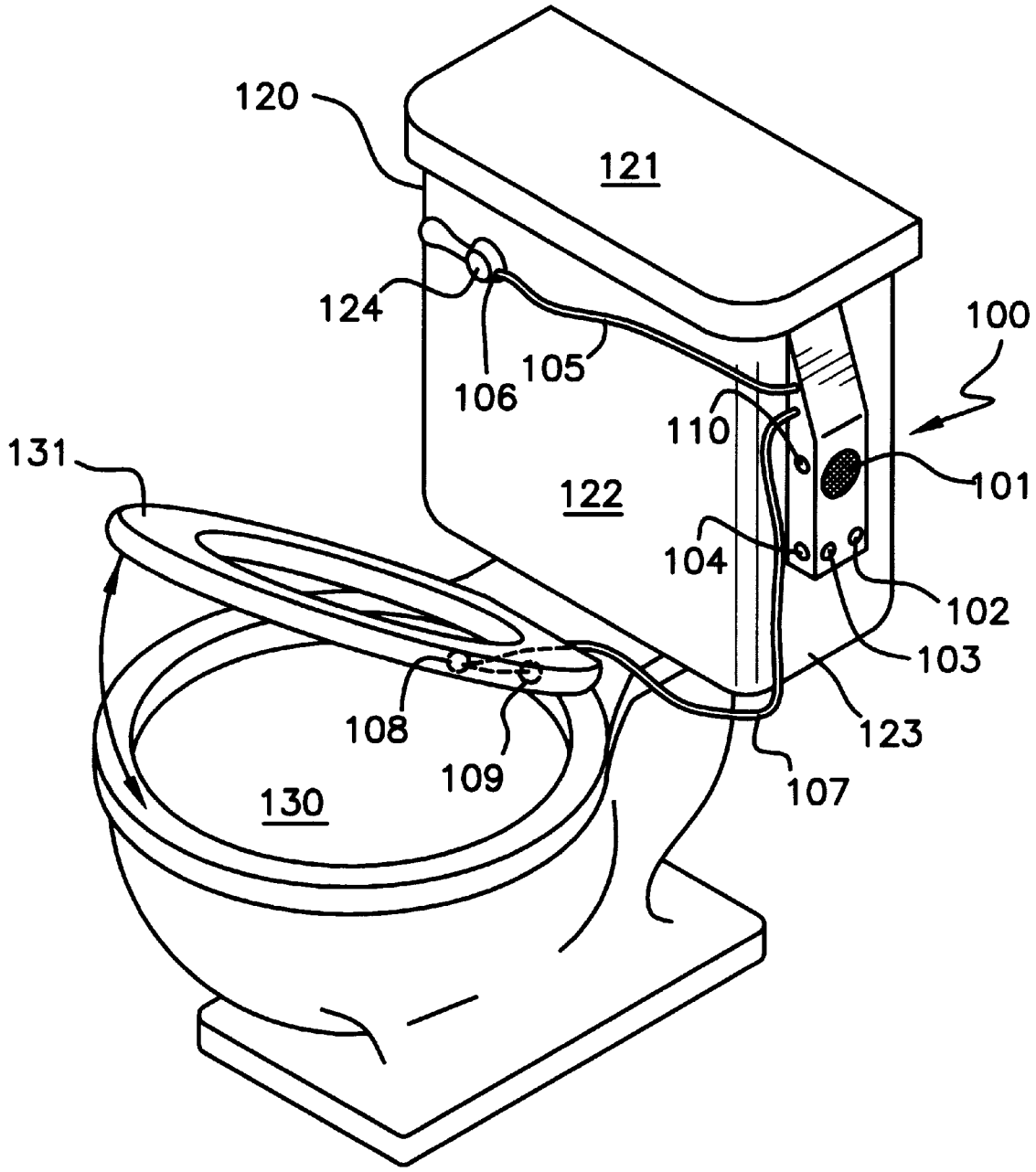
FIG. 1 is an environmental view of a toilet with the annunciator of the present invention mounted on the side of the toilet tank.

The annunciator of the present invention is shown in FIG. 1 in a small plastic housing 100 that hangs on the side 123 of a toilet tank 120. The housing 100 hangs from the upper edge of the tank 120, under the tank lid 121 as is known in the field of toilet alarms. Externally accessible components on the housing 100 include a speaker 101, a volume control 102, an on/off switch 103, and an infrared motion detector 104. An electrical cable 105 having a pair of electrical wires leads to a flush sensor 106 that provides an indication that the flush handle 124 has been depressed. A second electrical cable 107 has a second and third pair of electrical wires. The second pair of wares leads to a pressure sensor 108 in the toilet seat 131 that detects a person sitting on the seat, while the third pair leads to a tilt sensor 109 that detects whether the seat is raised or lowered on the bowl 130. A small light or LED 110 is provided on the housing 100. The light 110 comes on and flashes at appropriate moments to indicate the unit is working.

The sensors used in the present invention can be any of a number of standard off-the-shelf products that are well known for use in these types of applications. For example, the flush sensor 106 may he envisioned as Hall effect switch with a magnet on the handle to cause the Hall effect switch to open and close. The pressure switch 108 can be in the form of two contacts separated by a compressible substance. A person sitting on the toilet seat 131 causes the two contacts, to touch one another, thereby closing the switch 108. The tilt sensor 109 can be a mercury switch type tilt sensor, that is closed when the toilet seat 131 is in either the raised or lowered position, and open in the opposite position. The infrared motion detector 104 is similar to those used in lighting systems, and simply provides a closed contact as an indication of motion. All of the external wires and sensors are preferably plastic coated or wrapped in plastic sleeves to protect them from the environment and make them easier to clean. In addition, cables 105 and 107 can be routed to be less noticeable.

Figure 2:
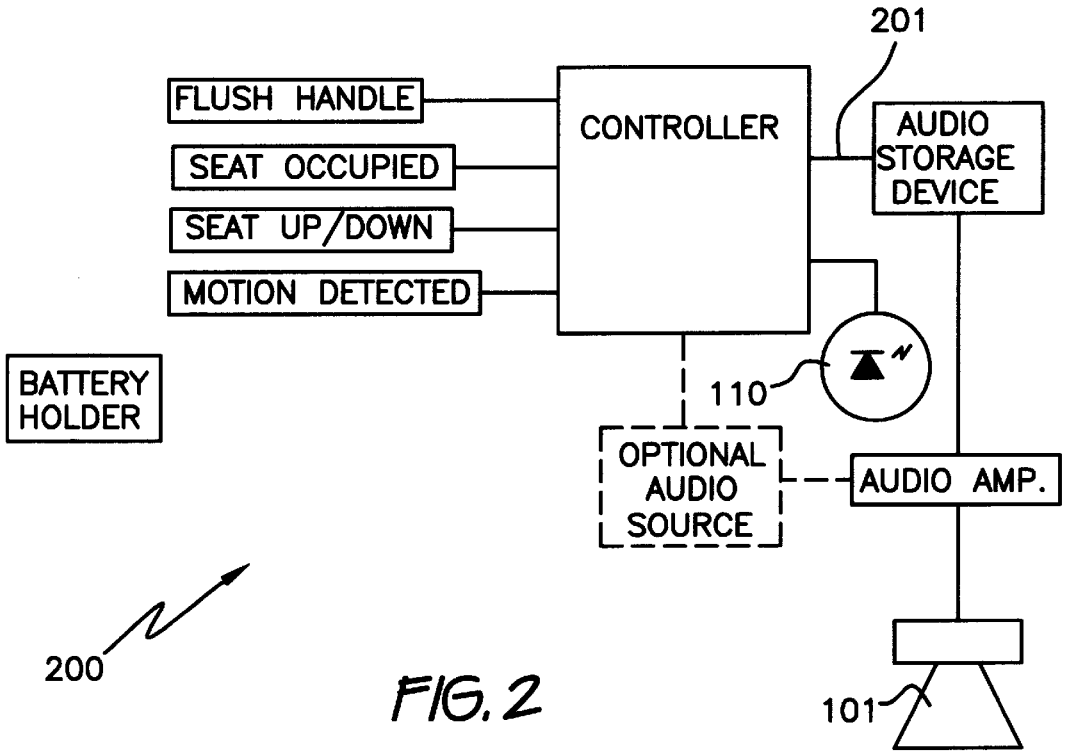
FIG. 2 is a block diagram of the annunciator of FIG. 1.

In FIG. 2 a block diagram of the annunciator 200 is shown. A battery power source provides the electrical voltage for the various circuits. The inputs from the flush handle, seat occupied, seat up/down and motion detected sensors are routed to a controller. The controller determines which prerecorded message or messages to play based on the inputs from the sensors, as described in the summary of the invention. The prerecorded messages are stored in an audio storage device which may be a tape recorder, but is preferable a digital storage device, allowing rapid random access to the various messages. Such devices are known in the smart house and smart car industries, and operate by assigning a numerical code to each message. When prompted to play, the device reads the code sent on an audio select input 201 and plays the prerecorded (and preprogrammed) message associated therewith. The output from the audio storage device is fed into an audio amplifier for playing through the speaker 101. An optional additional audio source may also be included. This audio source may be a tape player, a radio, a CD player, etc. Preferably, the audio source is a tape player that plays prerecorded tapes with "bathroom music" or humorous sounds. The optional audio source would be muted or lowered in volume by the controller, when messages are played.

The controller is preferable in the form of a microcomputer. In addition to receiving the raw signals from the sensors, the microcomputer includes a real time clock to associate events with changing signals from the sensor. For example, a closed circuit from the seat sensor directly following an open circuit is an indication of someone sitting down on the toilet seat, while an open circuit directly following a closed circuit from the seat sensor is an indication of someone getting up from the toilet seat. In addition, the raw signal from the motion detector may be combined with a delay loop to ensure a person is actually near the toilet, as opposed to signal spikes, or falling objects in the bathroom. This type of programming is well known, and a simple program can be written to achieve the results discussed in the summary above. The light 110 is either illuminated constantly or flashed in response to certain sensed conditions to indicate the controller is working.

Figure 3:
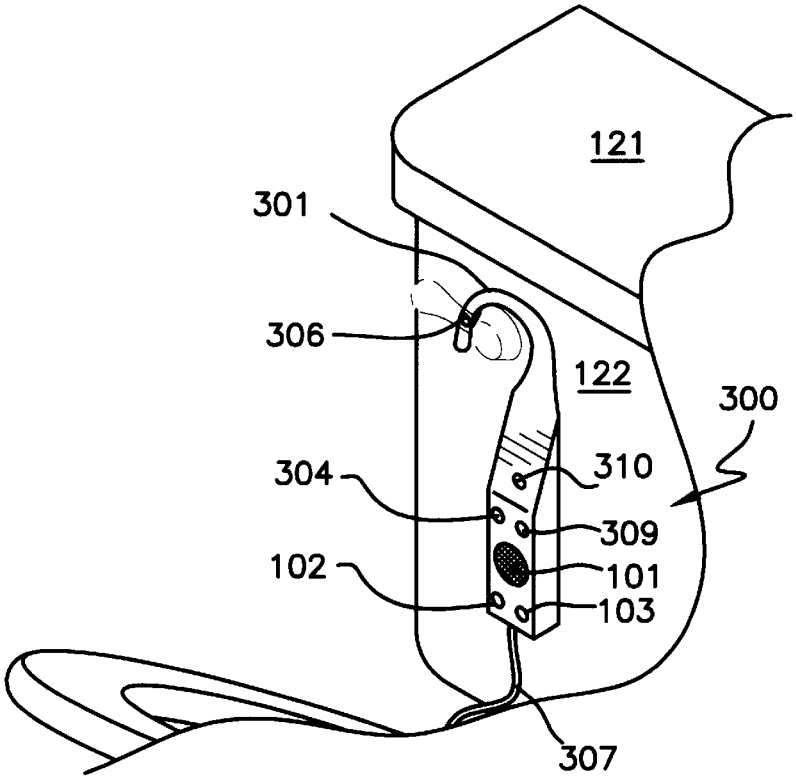
FIG. 3 is an environmental view of a second embodiment of the annunciator of the present invention, mounted on the flush handle of the toilet.

FIG. 3 illustrates a second embodiment 300 of the housing of the annunciator of the present invention. Housing 300 includes a hook 301 for supporting the housing on the shaft of the flush handle 124. This housing construction has the advantage of reducing the number of electrical wires and cables needed by mounting two additional sensors on the housing. In addition to the motion detector 304, both the flush handle sensor 306 and a seat position sensor 309 are incorporated into the housing 300. The seat position sensor 309 in this embodiment may be a simple push button switch that the seat depresses when raised. A cable 307 is still required to route the pair of wires to the seat occupied pressure sensor 108. As with the first embodiment a small light or LED 310 is mounted on the housing 300.

Either of the housings of the above embodiments of the invention could have various shapes and colors, but preferably they are plastic and in an easy to clean shape lacking crevices. For humorous reasons or to attract children, a preferred shape might be an animal such as a frog, that might also be appropriately colored green. In addition to various shapes, the annunciator could include a switch to instruct the controller to play humorous messages, messages intended for training children, messages for training men, or any combination of message types. Further, a third embodiment is contemplated, wherein the annunciator is built directly into the toilet seat. In this embodiment, the seat sensors as well as the motion detector could all be mounted in the housing, with the flush handle being the only external sensor.

It is to be understood that the present invention is not limited to the embodiments described above, but encompasses any and all embodiments within the scope of the following claims.

I claim:

1. An annunciator for a toilet having a seat and a flush handle, said annunciator comprising:

a battery for powering said annunciator;

a motion detector, said motion detector providing a first sensed signal indicative of the presence of a person within a predetermined distance from the toilet;

a seat up/down sensor, said seat up/down sensor providing a second sensed signal indicative of a position of the toilet seat;

a seat occupied sensor, said seat occupied sensor providing a third sensed signal indicative of a person sitting on the toilet seat;

a flush handle sensor, said flush handle sensor providing a fourth sensed signal indicative of operation of the flush handle;

an audio storage device having an audio select input, said audio storage device storing a plurality of stored audio messages, said audio storage device selecting and playing at least one of the stored audio messages that is associated with a code being placed on said audio select input;

a speaker;

an audio amplifier for receiving the at least one played audio message from said audio storage device, amplifying said message and feeding the amplified audio message to said speaker for projecting the at least one played audio message; and a controller, said controller receives said first, second, third and fourth sensed signals, decides which of the plurality of stored audio messages should be played based on said first, second, third and fourth sensed signals, and places said code associated with the at least one played message, on said audio select input.

2. The annunciator according to claim 1, further comprising a light, said light being turned on and off by said controller based on said first, second, third and fourth sensed signals.

3. The annunciator according to claim 1, further comprising an additional audio source, wherein:

said additional audio source provides a second audio signal to said audio amplifier; and said controller either mutes or decreases a volume of the second audio signal, when any of said plurality of messages are being played.

4. The annunciator according to claim 1, wherein the toilet further includes a toilet tank with a side, and wherein:

said annunciator further comprises a housing supported on the side of the toilet tank;

said battery, said motion detector, said audio storage device, said speaker, said audio amplifier and said controller are all mounted in said housing;

said flush handle sensor is electrically connected to said controller by a first electrical cable; and said seat up/down sensor and said seat occupied sensor is electrically connected to said controller by a second electrical cable.

5. The annunciator according to claim 1, wherein the toilet further includes a toilet tank with a front and a flush handle shaft operatively connecting the flush handle to the toilet, and wherein:

said annunciator further comprises a housing supported by the flush handle shaft on the front of the toilet tank;

said battery, said motion detector, said flush handle sensor, said seat up/down sensor, said audio storage device, said speaker, said audio amplifier and said controller are all mounted in said housing; and said seat occupied sensor is electrically connected to said controller by an electrical cable.

6. The annunciator according to claim 1, wherein:

said annunciator further comprises a housing built into the toilet seat;

said battery, said motion detector, said seat up/down sensor, said seat occupied sensor, said audio storage device, said speaker, said audio amplifier and said controller are all mounted in said housing; and said flush handle sensor is electrically connected to said controller by an electrical cable.

7. The annunciator according to claim 1, wherein:

when the motion detector provides a signal that indicates a person is within the predetermined distance;

when the seat up/down sensor provides a signal indicating the seat is in the lowered position;

when the seat occupied sensor provides a signal indicating that the seat is not occupied; and when the flush handle sensor provides a signal indicating that the handle is not being operated; then one of the at least one audio message selected and played is of a humorous nature; or no message is selected and played.

8. The annunciator according to claim 1, wherein:

when the motion detector provides a signal that indicates a person is within the predetermined distance;

when the seat up/down sensor provides a signal indicating the seat is in the raised position;

when the seat occupied sensor provides a signal indicating that the seat is not occupied; and when the flush handle sensor provides a signal indicating that the handle is not being operated; then the at least one audio message selected and played is of a warning nature and states that the seat is in the raised position.

9. The annunciator according to claim 1, wherein:

when the motion detector provides a signal that indicates a person is within the predetermined distance;

when the seat up/down sensor provides a signal indicating the seat is in the lowered position;

when the seat occupied sensor provides a signal indicating that the seat is occupied; and when the flush handle sensor provides a signal indicating that the handle is not being operated; then one of the at least one audio message selected and played is of a humorous nature;

the at least one audio message selected and played is one of a training nature and states that the toilet should be flushed and hands should be washed when the person is finished; or no message is selected and played.

10. The annunciator according to claim 1, wherein:

when the motion detector provides a signal that indicates a person is within the predetermined distance;

when the seat up/down sensor provides a signal indicating the seat is in the lowered position;

when the seat occupied sensor provides a signal indicating that the seat is not occupied immediately after the seat occupied sensor provides a signal indicating that the seat is occupied; and when the flush handle sensor provides a signal indicating that the handle is not being operated; then the at least one audio message selected and played is one of a training nature and states that the toilet should be flushed and hands should be washed.

11. The annunciator according to claim 1, wherein:

when the motion detector provides a signal that indicates a person is within the predetermined distance;

when the seat up/down sensor provides a signal indicating the seat is in the lowered position;

when the seat occupied sensor provides a signal indicating that the seat is not occupied immediately after the seat occupied sensor provides a signal indicating that the seat is occupied; and when the flush handle sensor provides a signal indicating that the handle is being operated; then the at least one audio message selected and played is one of a praising nature and states thank you.

12. The annunciator according to claim 1, wherein:

when the motion detector provides a signal that indicates a person is within the predetermined distance;

when the seat up/down sensor provides a signal indicating the seat is in the raised position directly after the seat up/down sensor provides a signal indicating the seat is in the lowered position;

when the seat occupied sensor provides a signal indicating that the seat is not occupied; and when the flush handle sensor provides a signal indicating that the handle is not being operated; then the at least one audio message selected and played is of a training nature and states to remember to lower the seat and flush the toilet when finished.

13. The annunciator according to claim 1, wherein:

when the motion detector provides a signal that indicates a person is within the predetermined distance;

when the seat up/down sensor provides a signal indicating the seat is in the raised position;

when the seat occupied sensor provides a signal indicating that the seat is not occupied; and when the flush handle sensor provides a signal indicating that the handle is not being operated; then the at least one audio message selected and played is of a training nature and states to lower the seat and flush the toilet.

14. The annunciator according to claim 1, wherein:

when the motion detector provides a signal that indicates a person is within the predetermined distance;

when the seat up/down sensor provides a signal indicating the seat is in the raised position;

when the seat occupied sensor provides a signal indicating that the seat is not occupied; and when the flush handle sensor provides a signal indicating that the handle is being operated; then the at least one audio message selected and played is of a training nature and states to lower the seat and wash hands.

15. The annunciator according to claim 1, wherein:

when the motion detector provides a signal that indicates a person is within the predetermined distance;

when the seat up/down sensor provides a signal indicating the seat is in the lowered position immediately after the seat up/down sensor provides a signal indicating the seat is in the raised position;

when the seat occupied sensor provides a signal indicating that the seat is not occupied; and when the flush handle sensor provides a signal indicating that the handle is not being operated; then the at least one audio message selected and played is of a praising nature and states thank you.

16. The annunciator according to claim 1, wherein when the motion detector provides a signal that indicates no person is within the predetermined distance, no message is selected and played.

* * * * *